US006890155B2

(12) United States Patent
Cartwright

(10) Patent No.: US 6,890,155 B2
(45) Date of Patent: May 10, 2005

(54) FAN BLADE

(76) Inventor: Thomas Cartwright, 10 Perriwinkle Cir., Stuart, FL (US) 34996

( * ) Notice: Subject to any disclaimer, the term of this patent is extended or adjusted under 35 U.S.C. 154(b) by 204 days.

(21) Appl. No.: 10/243,639

(22) Filed: Sep. 11, 2002

(65) Prior Publication Data

US 2004/0047735 A1 Mar. 11, 2004

Related U.S. Application Data

(63) Continuation-in-part of application No. 29/162,811, filed on Jun. 21, 2002, now abandoned, and a continuation-in-part of application No. 29/159,732, filed on Apr. 29, 2002, now Pat. No. Des. 491,657.

(51) Int. Cl.[7] ..... F04D 29/38
(52) U.S. Cl. ..... 416/229 R; 416/230
(58) Field of Search ..... 416/62, 131, 132 R, 416/134 R, 146 R, 210 R, 229, 230, 229 R

(56) References Cited

U.S. PATENT DOCUMENTS

| | | | |
|---|---|---|---|
| 4,342,073 | A | 7/1982 | Ranten |
| 4,357,506 | A | 11/1982 | Breining |
| 4,518,314 | A | 5/1985 | Schultz |
| 4,598,632 | A | 7/1986 | Johnson, III |
| 4,884,947 | A | 12/1989 | Rezek |
| 4,892,460 | A | 1/1990 | Volk |
| RE33,347 | E | 9/1990 | Johnson, III |
| 5,110,261 | A | 5/1992 | Junkin |
| 5,154,579 | A | 10/1992 | Rezek |
| RE34,147 | E | 12/1992 | Rezek |
| 5,222,864 | A | 6/1993 | Pearce |
| 5,292,228 | A | 3/1994 | Dye |
| 5,338,156 | A | 8/1994 | Chien |
| 5,348,445 | A | 9/1994 | Jwd |
| 5,383,765 | A | 1/1995 | Baxter et al. |
| 5,462,407 | A | 10/1995 | Calvo |
| 5,470,205 | A | 11/1995 | Conklin, Jr. |
| 5,564,900 | A | 10/1996 | McAuley |
| 5,601,412 | A | 2/1997 | Vice |
| D378,312 | S | 3/1997 | Davis, Jr. |
| 5,624,230 | A | 4/1997 | Taylor et al. |
| 5,658,129 | A | 8/1997 | Pearce |
| D387,156 | S | 12/1997 | Johnson |
| D388,513 | S | 12/1997 | Jaspers-Fayer |
| 5,839,881 | A | 11/1998 | Yu |
| 5,967,754 | A | 10/1999 | Chou |
| 6,010,306 | A | 1/2000 | Bucher et al. |
| 6,027,310 | A | 2/2000 | Kerr, Jr. et al. |
| 6,036,154 | A | 3/2000 | Pearce |
| 6,039,533 | A | 3/2000 | McCabe |

(Continued)

OTHER PUBLICATIONS

Price List for LC Designs, Inc. fan blades.
Catalog for LC Designs, Inc. fan blades.
Photograph of pinwheel fan blade at Disneyworld.
Web page showing current pinwheel fan blade.
Copyright application for Island Fans Flyer.
Copyright search results for L C Designs, Inc.
Copyright application for Bahama Bent Blade.

*Primary Examiner*—Edward K. Look
*Assistant Examiner*—Richard A. Edgar
(74) *Attorney, Agent, or Firm*—Thomas R. FitzGerald, Esq.; Laurence S. Roach, Esq.

(57) ABSTRACT

A fan blade has a three dimensional shape that resembles a leaf. The blade is made of balsa or other suitable wood with the grain of the wood running along its length. The obverse surface of the blade is contoured and has a central vein and lateral veins running from the central vein to opposite edges. The reverse side has one or more channels. Braces are set in the channels. The braces are also made of balsa or comparable wood and their grain runs transverse to the direction of the gain of the blade.

8 Claims, 10 Drawing Sheets

U.S. PATENT DOCUMENTS 6,039,541 A 3/2000 Parker et al.
6,045,329 A 4/2000 Sobala
D424,190 S 5/2000 Tang
6,079,947 A 6/2000 Gabriel et al.
D432,640 S 10/2000 Frampton
D433,118 S 10/2000 Frampton
D433,119 S 10/2000 Frampton
D433,498 S 11/2000 Frampton
D433,747 S 11/2000 Frampton
D433,749 S 11/2000 Frampton
6,146,097 A 11/2000 Bradt
D437,047 S 1/2001 Frampton
6,168,285 B1 1/2001 Flohre
6,171,059 B1 1/2001 Bucher et al.
D437,406 S 2/2001 Frampton
6,210,117 B1 4/2001 Bucher et al.
6,213,716 B1 4/2001 Bucher et al.
D443,352 S 6/2001 Lantz
D443,353 S 6/2001 Lantz
6,309,183 B1 10/2001 Bucher et al.
6,335,792 B1 1/2002 Tsuchiya
D453,566 S 2/2002 Lantz
D454,636 S 3/2002 Lantz
6,352,411 B1 3/2002 Bucher et al.
6,364,612 B1 4/2002 Tseng
6,390,778 B1 5/2002 Lee
6,394,756 B1 5/2002 Bucher et al.
6,419,451 B1 7/2002 Moody et al.
D463,543 S 9/2002 Lantz
6,508,629 B2 1/2003 Kerr, Jr.
2003/0202881 A1 * 10/2003 MacCuaig ..... 416/62

* cited by examiner

FIG. 4C
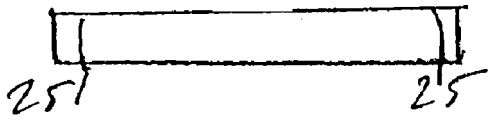
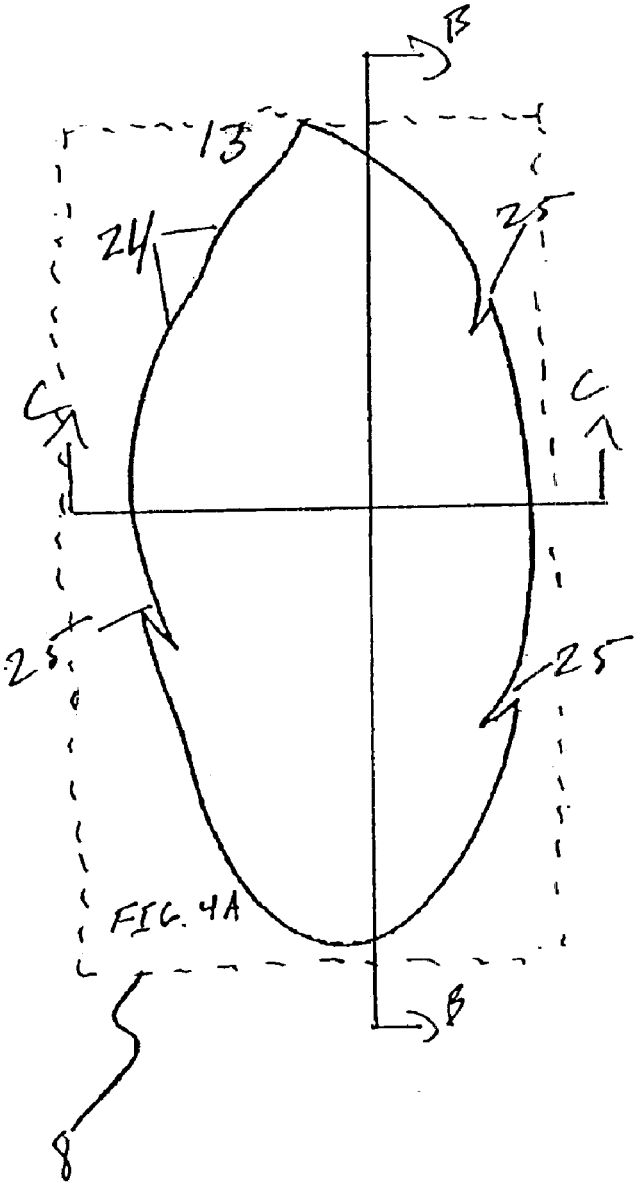
FIG. 4A
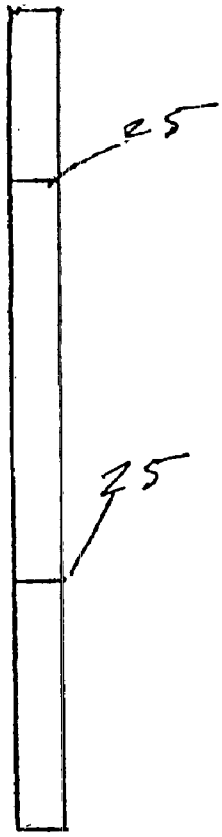
FIG. 4B
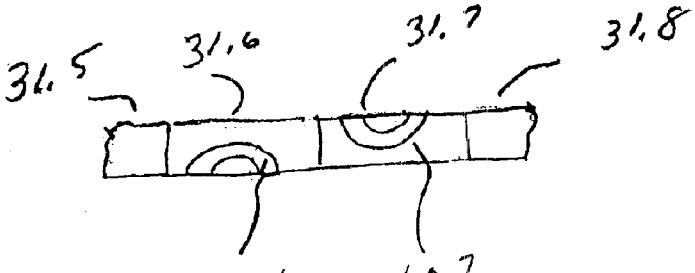
FIG. 4D

FAN BLADE

CROSS-REFERENCE TO RELATED APPLICATIONS

This application is a continuation-in-part of and claims the benefit of the priority date of U.S. Des. application Ser. No. 29/162,811 filed Jun. 21, 2002 (abandoned) and U.S. Des. application Ser. No. 29/159,732 filed Apr. 29, 2002 now issued as U.S. Des. Pat. No. D491,657.

BACKGROUND

The field of this invention relates in general to ceiling fans, and in particular to light weight, wooden fan blades that resemble items or nature such as leaves.

Ceiling fans a popular commercial and consumer items. They move air in a room to more evenly distribute the air and thus keep the room at a more constant temperature. Ceiling fans are often used to cool people by providing a stream of air over their bodies. The air stream enhances body cooling by evaporating any surface body moisture and by removing heat from the surface of the skin.

Ceiling fans also have a decorative function. Their blades can assume a variety of shapes and can be made of plastic, wood or metal. One popular shape is the palm leaf blade such as shown in U.S. Pat. No. D433,747. Some manufacturers make their blades from natural fibers. However, these are often woven together and are free to rotate about a central axis because the natural fibers are no strong enough to withstand normal rotational and aerodynamic forces. Other makes blades of plastic which to do not have the ambiance, look and feel of a natural leaf. Often such blades have flat surfaces and only resemble leaves in their contours. Three dimensional blades require blade bodies that are relatively thick so that contours can be shown. Plastic and metal are often too heavy and otherwise do not present a natural appearance.

Wood as a blade material has other problems. Dense woods such as oak or mahogany are often too heavy for conventional light-weight fan motors, although it is possible to increase the bearing size of the fan motor. A wooden fan blade resembling a leaf would likely be between five-eights to three quarters inch thick. Wooden blades are made of longitudinal strips of wood that have their sides laminated together. Due to thermal cycling and operational stress, the laminated wooden blades may crack along the length of the blade. Under impact the blade could separate into one or more pieces and send harmful missiles about a room.

SUMMARY OF THE INVENTION

In one aspect of the invention, a blade for a ceiling fan comprises an elongated member having a shape corresponding to a leaf with a length grater than its width and with a perimeter having opposite sides. In one embodiment the blade is made from a number of strips of wood that are laminated together along their longer edges. It is preferred that the grains of the strips run along the length and that alternate strips have their curved grains facing in opposite directions. One or more cross braces on the back side of the blade prevent the strips from delaminating or separating. In an alternate embodiment, the elongated member may comprise a single sheet of wood having its grain disposed in the elongated direction or have an obverse surface with an irregular topology and a reverse surface having a generally planar topology. The reverse surface may have one or more cross braces extending generally transverse to the grain of the wooden elongated member for supporting the elongated member.

In certain embodiments, the wood of the fan blade is balsa or other light weight woods selected from the group consisting of balsa, butternut, jelutong, eastern white pine, sugar pine, aspen, poplar, alder, spruce, paulowina, basswood, fir, hemlock, chestnut, teak, cedar, plastic, particle board, and resin impregnated wood particles In accordance with other aspects of the invention, the elongated member has one or more channels that have a floor and sidewalls spaced apart by the floor. The channels are filled with a wood brace member that has its grain running along the length of the brace member and the transverse to the grain of the elongated member.

BRIEF DESCRIPTION OF THE DRAWINGS

FIG. 4A is a top view of a blank of the fan blade of 2A.

FIG. 4B is a side view of a blank of the fan blade of 2A.

FIG. 4C is a front-on view of a blank of the fan blade of 2A.

FIG. 4D is a partial cross section of the strips of wood that comprises one embodiment.

DETAILED DESCRIPTION OF THE INVENTION

Figure 1:
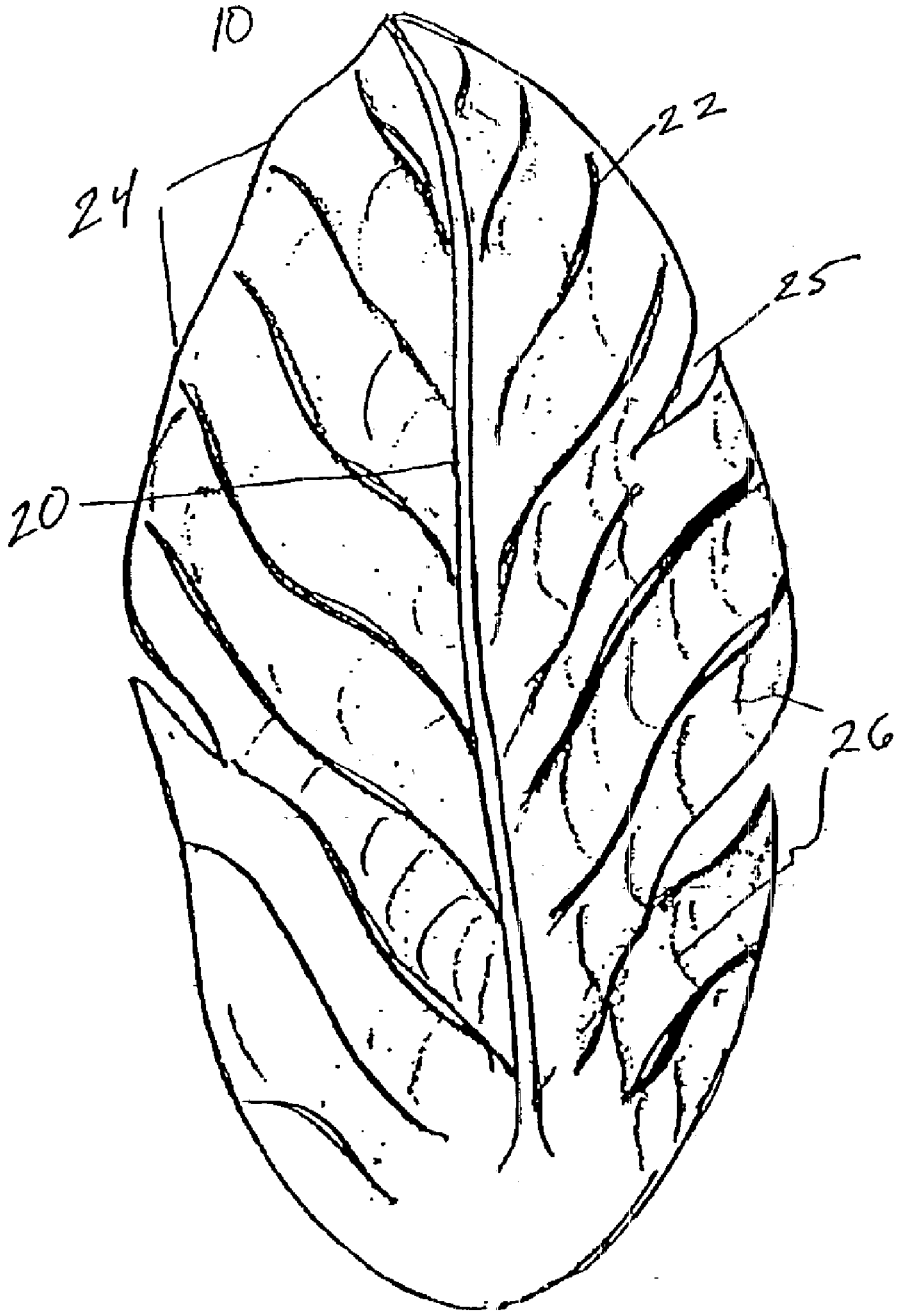
FIG. 1 is a top view of one embodiment of the obverse surface of a fan blade.

In FIG. 1 the obverse surface 10 is irregular and carved in the fashion of a leaf. In its preferred embodiment it has a central serpentine vein 20. Emanating from the central vein 20 are peripheral or lateral veins 22 that extend to the perimeter. The obverse surface 10 also has lifelike contouring 26 and an undulating perimeter 24 that resembles a three dimensional leaf structure. The perimeter has indentations 25 where adjacent portions of the leaf split from each other along a lateral vein 22.

Figure 2C:
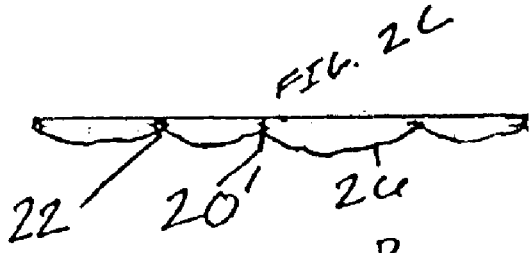
FIG. 2C is a front-on view of a finished fan blade.
Figure 2A:
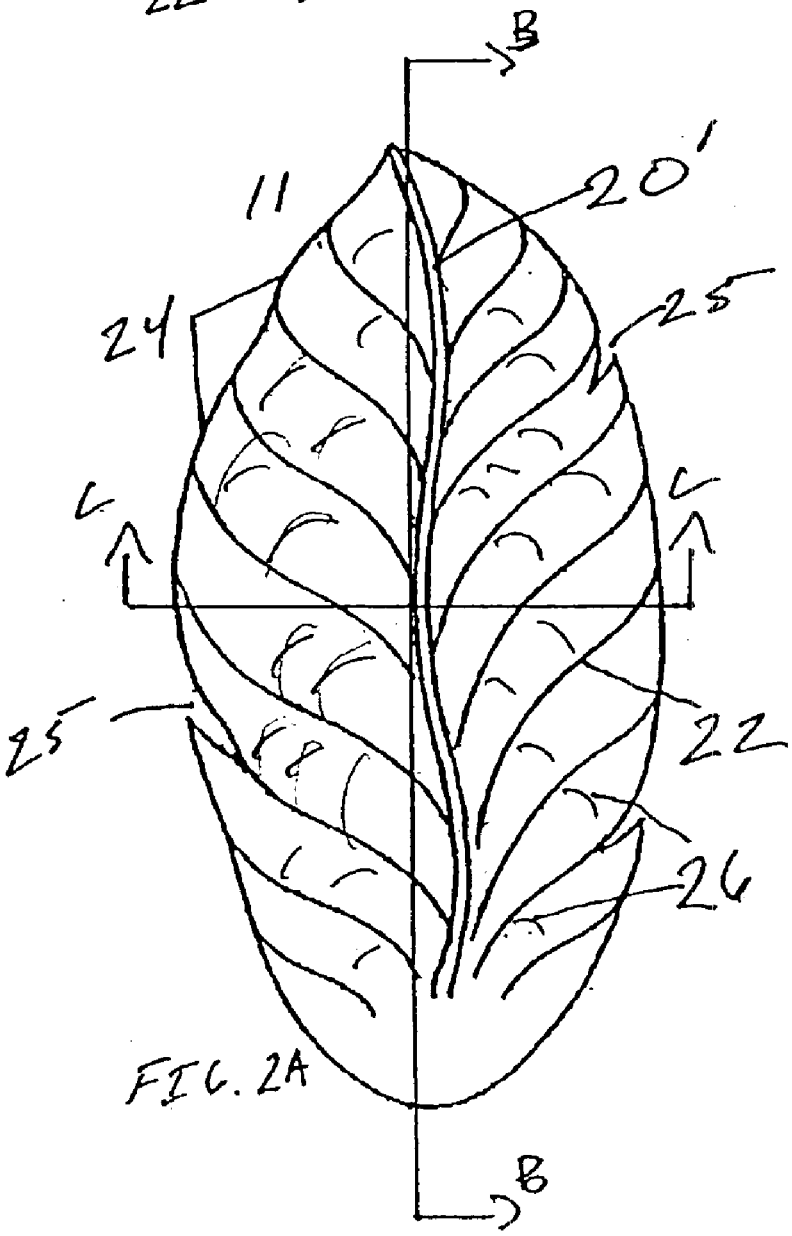
FIG. 2A is a top view of the obverse surface of a finished fan blade with a serpentine central vein.
Figure 2B:
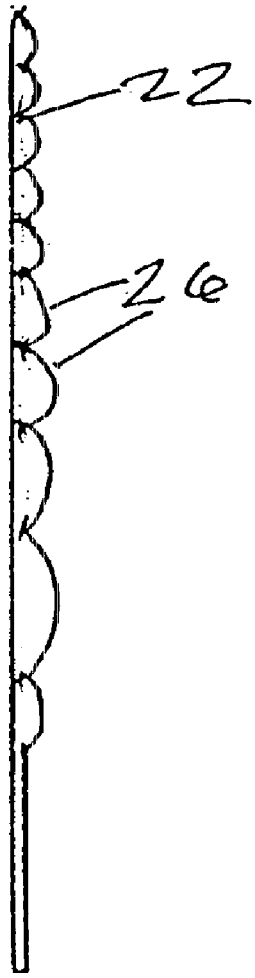
FIG. 2B is a side view of a finished fan blade.

Turning to FIGS. 2A–C, there is shown a second embodiment 11. It has a more steeply curved serpentine central vein 20' than in FIG. 1, but either embodiment is permissible. The same indentations 25, peripheral veins 22, and undulating perimeter 24 are present in this embodiment as well. As further shown in FIG. 2B the leaf 11 has an irregular obverse surface 26. It also has the effect of the lower positioning of the peripheral veins 22 within the carved wood. There are elevated portions 26 between recesses 22 which are the lateral veins 22.

Figure 3:
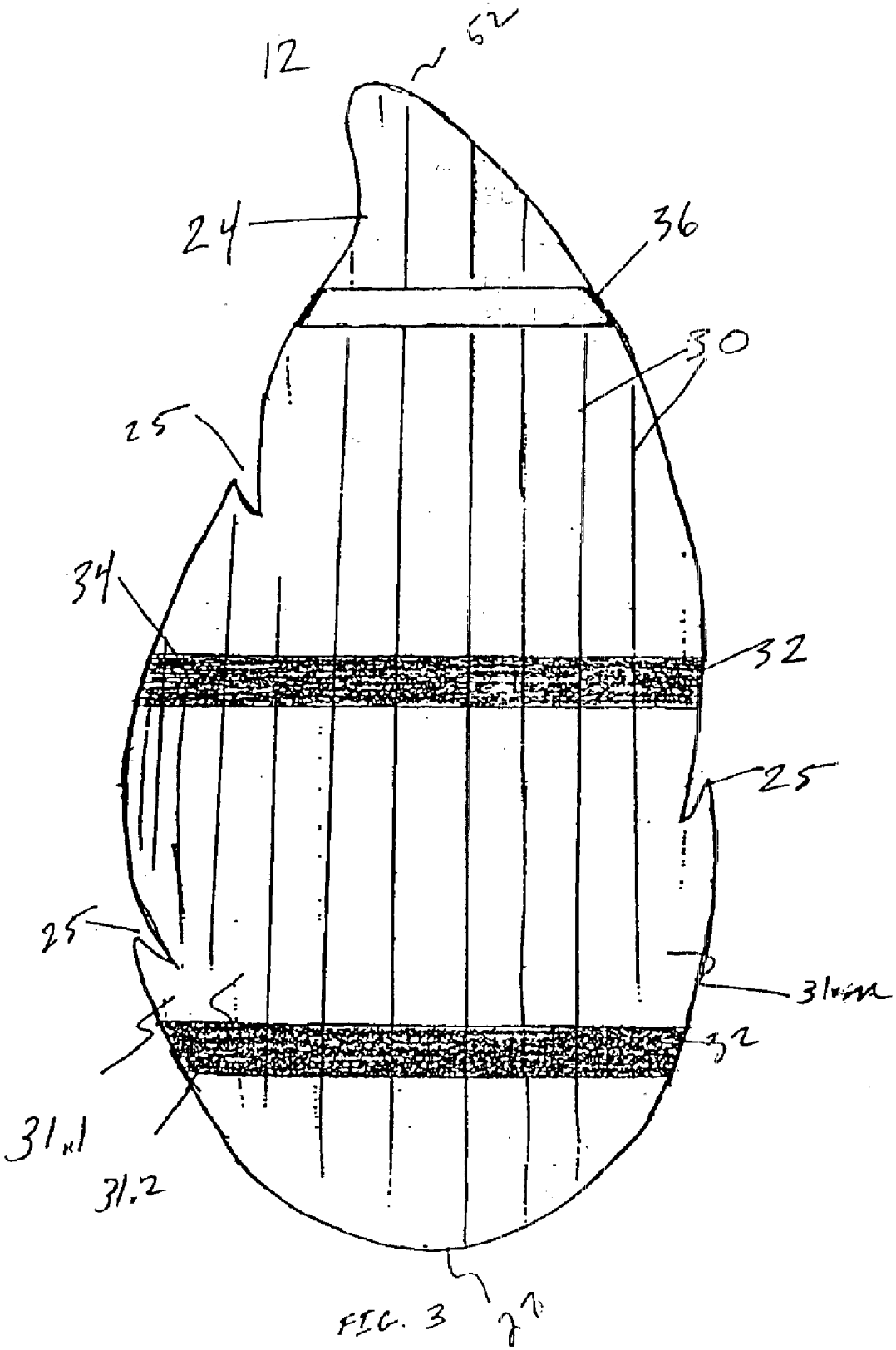
FIG. 3 is a top view of the reverse surface of a fan blade featuring the cross braces and direction of the grain.
Figure 5:
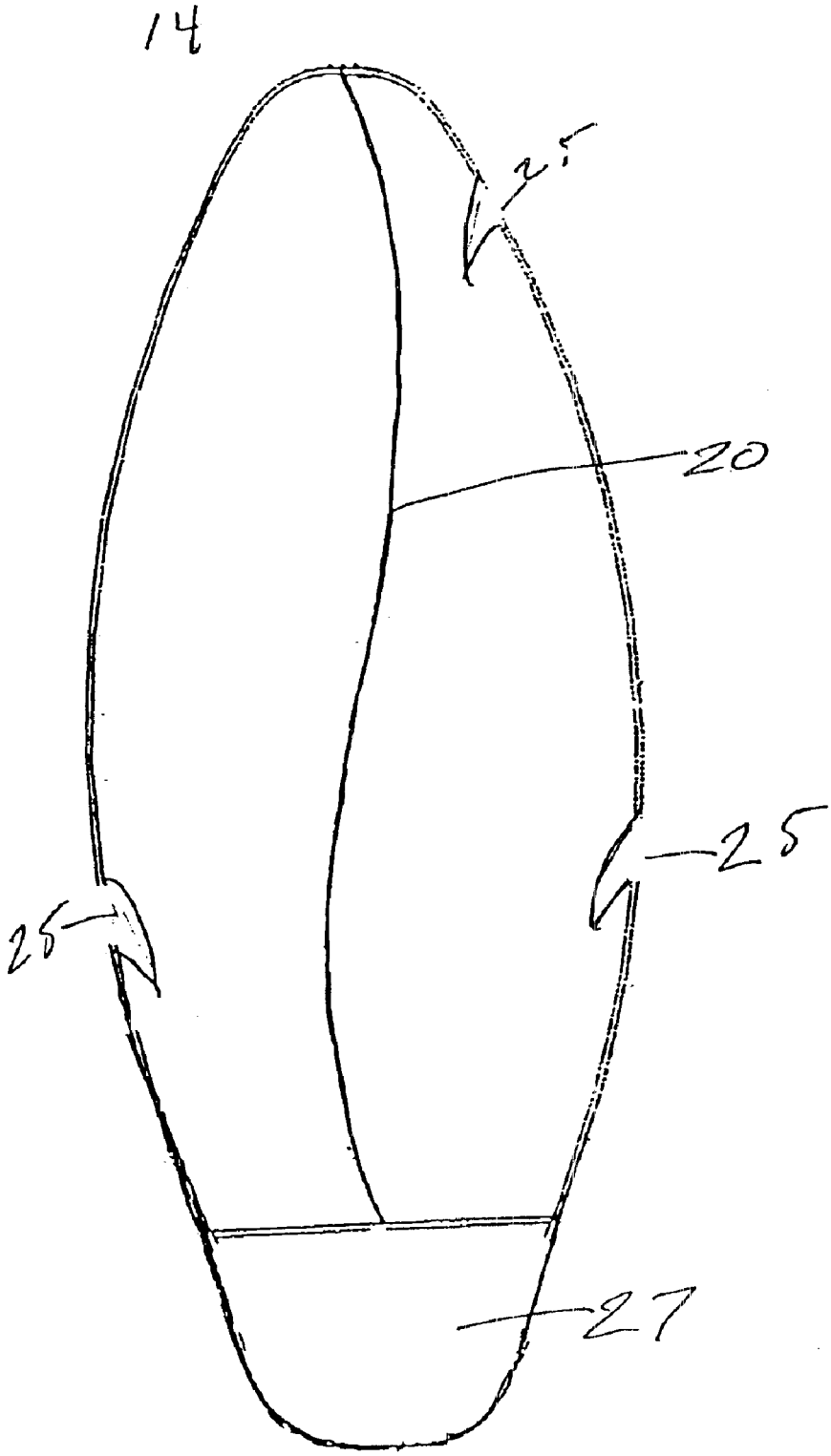
FIG. 5 is a top view of the obverse surface of a fan blade blank with a central serpentine vein.

The reverse surface 12 is illustrated in FIG. 3. The original sheet of wood 30 includes a number of laminated strips of wood 31.1, 31.2 . . . 31.n that run from the blade holder end 27 to the tip 52. The strips 31.n are previously glued or otherwise laterally fixed to adjacent strips to form a rectangular wooden sheet. The reverse side 12 has a flat or planar and regular surface except for one or more channels 36. The channels are cut into the wood and may be spaced evenly and disposed perpendicular to the strips 31.n of the cut-out leaf shape. In each channel 36 there is a piece of balsa or another strip of wood 32 with its grain 34 running transverse or perpendicular to the strips 31.n of the original block. These transverse or cross braces 32 are glued or otherwise fixed in place in the channels 36.

Laminated sheets of wood are prone to separate from each other if they are not properly assembled with their respective curvatures of grain facing in opposite direction. See FIG. 4D. Notice how the curvature of the grain 60.6 in strip 31.6 is opposite the curvature of grain 60.7 in strip 31.7. However, if the strips are assembled with the grains running in the same directions of curvature, the laminated structure is weakened. It may split along it length due to thermal and moisture stresses that act on the blade or it may split upon impact if and object strikes the blade. Without the cross braces, the pieces of the split blade would separate and the centrifugal force of the rotating fan motor would hurl the pieces outward. The broken, flying pieces could become dangerous missiles that could injure a person or property.

It is also known that solid wood pieces can crack along their grain. In an alternate embodiment, the blade may be made from a single, solid piece of wood, such as balsa wood. The cross braces 32 attend to the problem of longitudinal cracks. Once in place, they serve to prevent cracks from occurring and, when cracks occur, they further serve to hold together the elongated leaf. With the braces across the reverse side 32, the bulk of the leaf blade is held together.

FIGS. 4A–C & 5 illustrate the manufacturing process for the fan blade and show a blade in one or more of its stages of manufacture. A block of balsa wood 8 represented by the dotted lines surrounding the leaf 13 in FIG. 4*a* is cut into the leaf shape either by hand or by use of machines. This is accomplished by manually following a pattern or inputting the desired pattern into a computer controlled cutting machine. As in FIG. 5, one side 14 will be carved by hand or machined starting with the central vein 20. Then the peripheral veins will be carved 22. The effect of the carving is to create an irregular and life-like representation of a leaf. Finally, the blade holder end 27 on the obverse side is shaven or flattened to accommodate attachment of a fan motor to the blade.

Figure 6:
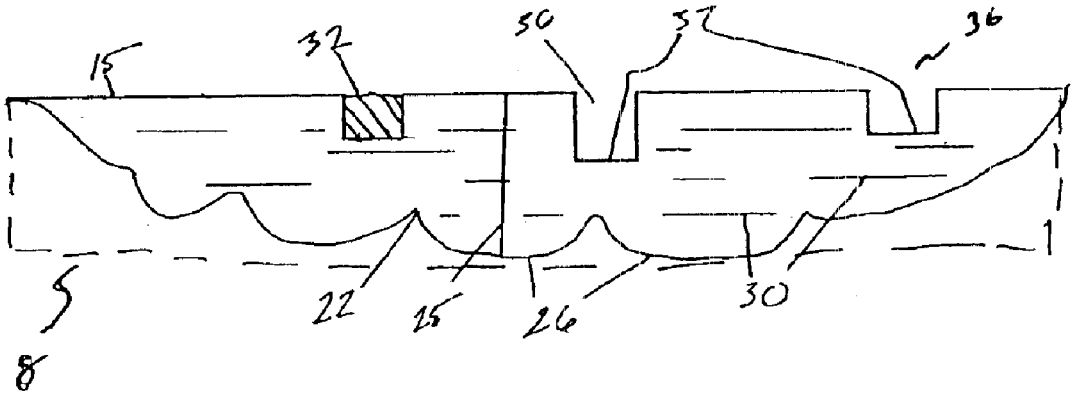
FIG. 6 is a cross-section view of a blade cut along the center in the elongated direction demonstrating the empty channels.

FIG. 6 shows how one side 15 will be routed one or more times to create the proper channels 36 for the braces 32 to be affixed by glue or other means. Each channel extends from the reverse surface into the wood. Since the blade may have different thickness at each channel location, it is not required that all channels have the same depth. Nor do their floors have to be in a common plane.

Figure 7:
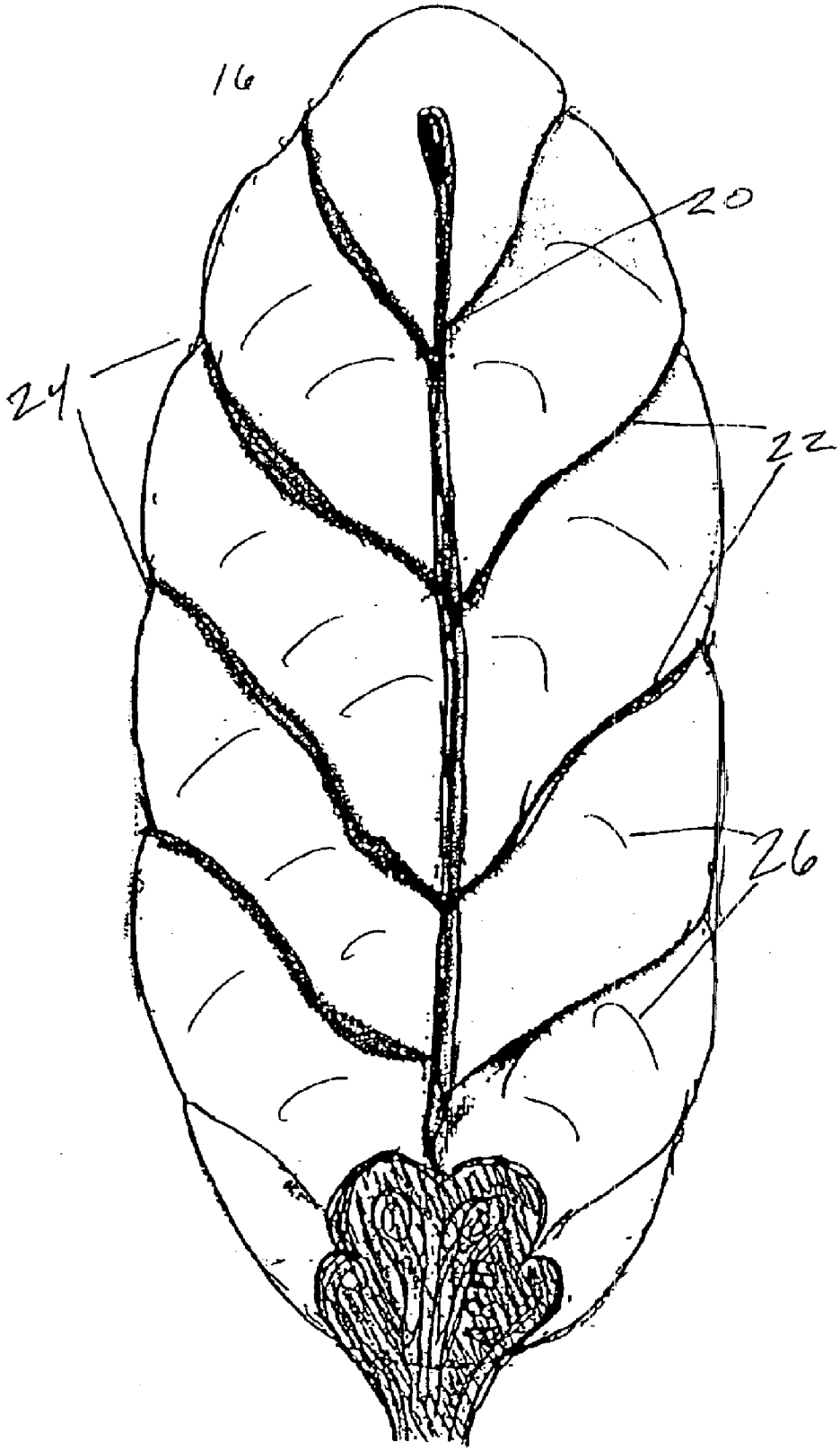
FIG. 7 is a top view of the obverse surface of a second embodiment of a fan blade.
Figure 8:
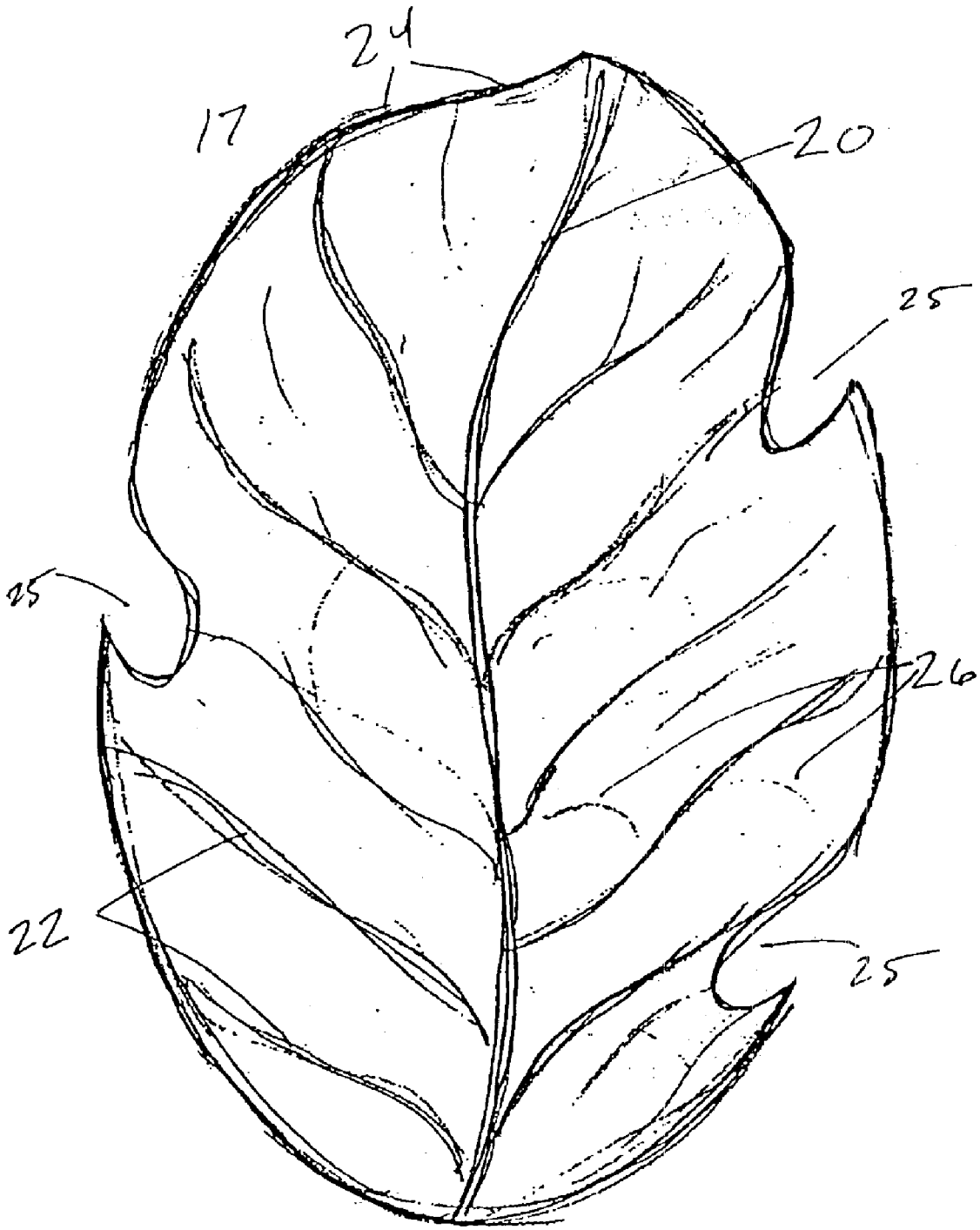
FIG. 8 is a top view of the obverse surface of a third embodiment of a fan blade.
Figure 9:
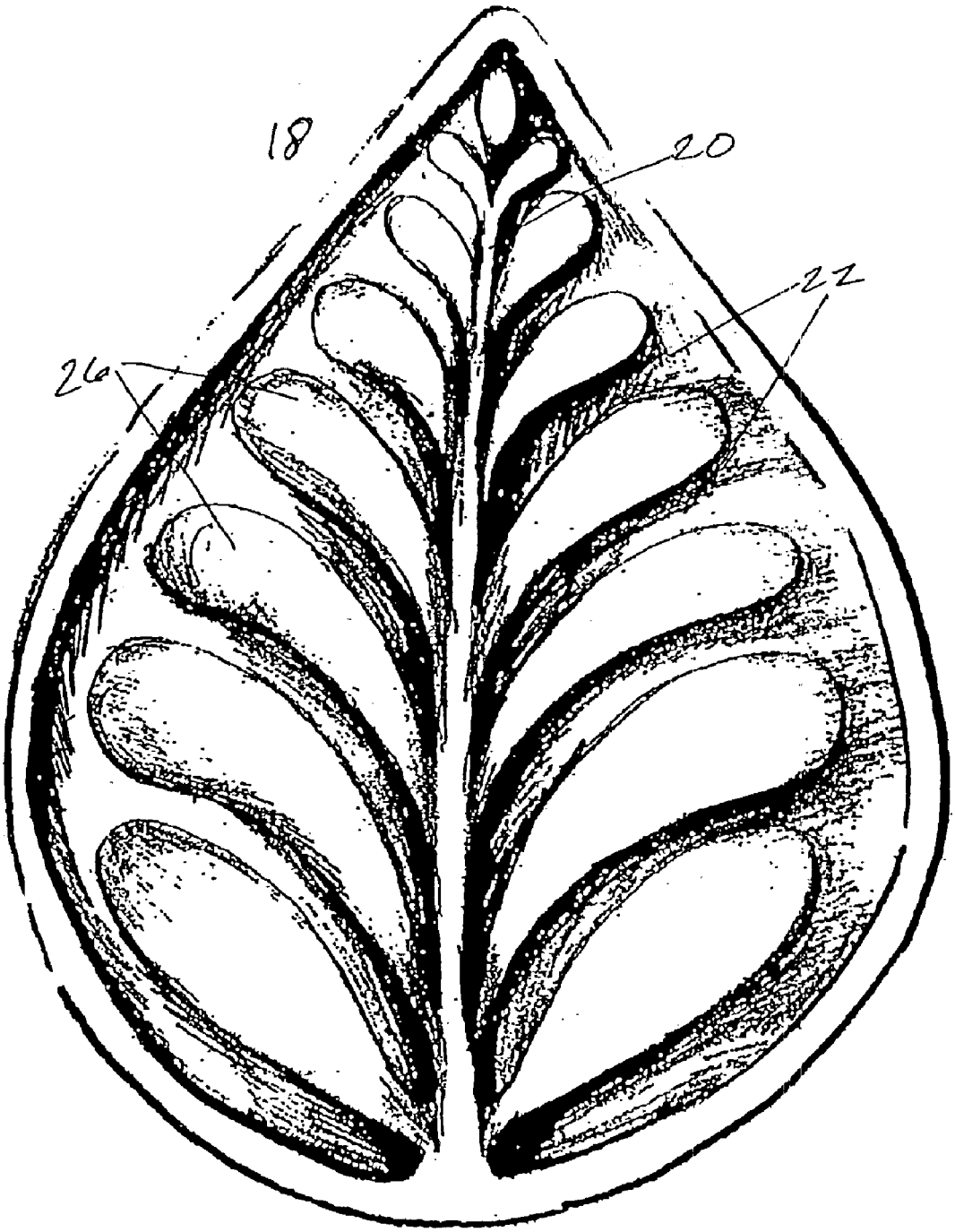
FIG. 9 is a top view of the obverse surface of a fourth embodiment of fan blade.

FIGS. 7, 8 & 9 are alternate surface patterns and shapes that might also be achieved by this process. Each will feature cross braces 32 arranged in the same manner as described above. In one alternate embodiment 16 the central vein 20 is straighter than is some other embodiments and the contoured sections 26 are more uniform. The lateral or peripheral veins 22 extend in an equally more uniform fashion. The undulating perimeter 24 remains, but the indentations 25 are removed.

In a second alternate embodiment 17 the central vein 20 and the peripheral veins are less uniform and, again, serpentine. The contouring 26 is accordingly less uniform as is the undulation 24. One novel difference is the rounding of the indentations 25 around the perimeter.

In a third alternate embodiment 18 the central vein is straight 20. The lateral veins 22 and contouring 26 are uniform, decreasing in size as the contouring 26 moves farther from the base 27. The perimeter does not undulate.

Figure 10:
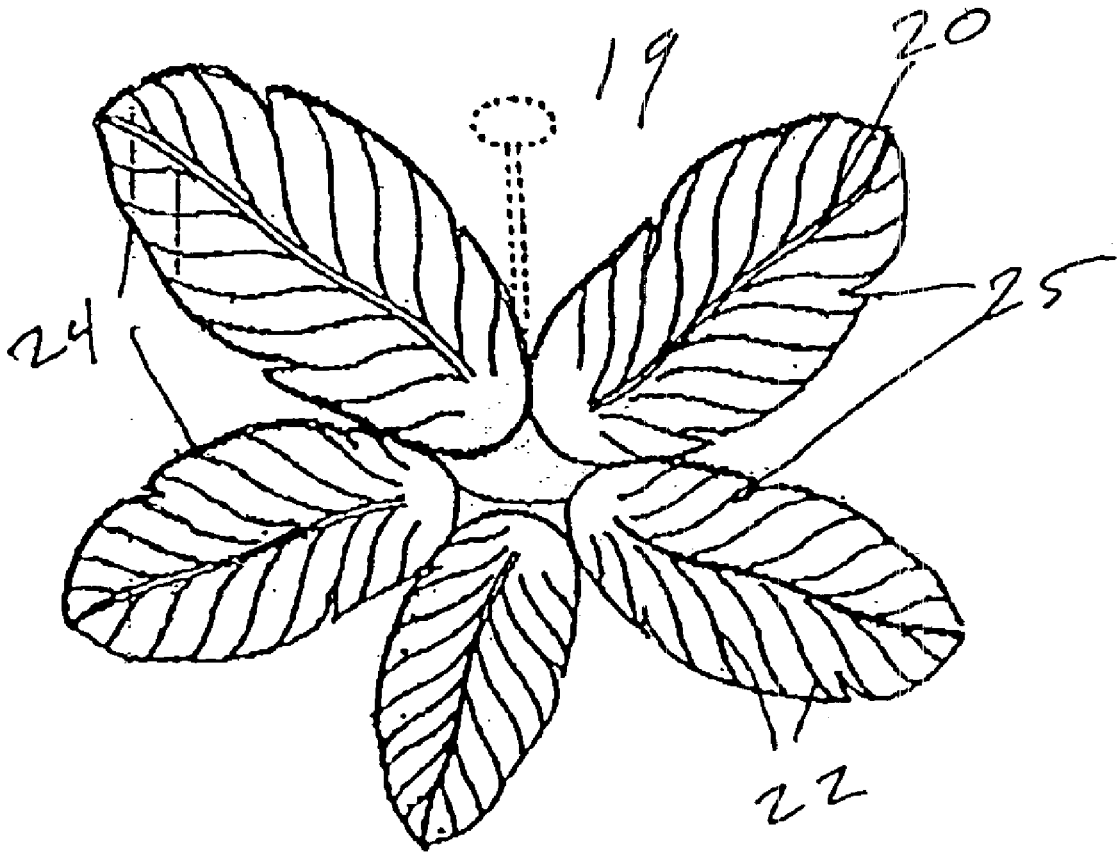
FIG. 10 is an underside view of a completed fan featuring 5 fan blades.

FIG. 10 is a rendering of the possible arrangement of the described blade as used in a ceiling fan.

It will be appreciated by those of ordinary skill in the art having the benefit of this disclosure that the embodiment of the transverse opposing grain bracing is capable of numerous variations without departing from the scope and spirit of the invention. It is fully intended that the invention for which a patent is sought encompasses within its scope all such variations without being limited to the specific embodiment disclosed above. For example, there are equivalent means for bracing the sheet or strips of wood. These include and are not limited to applying a fabric, such as a mesh, and glue to the reverse side to keep the strips together. The cross braces could also be raised and mounted on the surface of the reverse side.

The natural appearance of a leaf can also be represented by artificial materials. For example, one could prepare a fan blade from a foam material that is molded in the shapes of a leaf and wrapped or otherwise reinforced with fiberglass or carbon fiber material and/or epoxy. The wrapping or epoxy is used to maintain the integrity of the blades if the blade is impacted by an object, such as a broom handle or other object that may enter the circular path of the rotating blade. Such a blade is made from a foam core which may include a mold insert of a suitable backbone material. The mold is shaped to resemble a leaf with suitable droops and curls. The mold can be chosen to resemble a smooth leaf or a wrinkled leaf.

The mold can be made of wood and/or the wooden mold can then be used to make an aluminum mold. In one embodiment a backbone insert with a central vein and lateral veins of solid metal or plastic is inserted into the mold. Then a suitable foam molding material is injected or transferred into the mold. The foam solidifies into the shape of a leaf. The molded leaf is wrapped with a fabric such as fiberglass cloth or carbon fiber cloth. The wrapped leaf is then coated with a resin to hold the cloth to the foam body.

With the molded fan blade one can fashion the blade into a suitable configuration to optimize its performance. The body of the blade can include curved surfaces that improve its air handling capability. Such curves are common features in fans that are substantially functional. The advantage of the molded leaf blade is that it can be aesthetically pleasing as well as functional.

The invention has been described in connection with paulowina wood, but other types of wood may be used. Paulowina is stable in use and is easy to cut, shape and sand. Other woods with comparable properties are balsa, butternut, jelutong, eastern white pine and sugar pine. Other pines may be used along with aspens, poplars, alders, spruce, basswood, fir, hemlock, chestnut, teak and cedar. In lieu of wood, one skilled in the art could substitute other natural or manufactured materials, such as particle board, resin impregnated wood particles formed into strips, one or more structural plastic materials or extruded fiberglass material.

What I claim is:

1. A blade for a ceiling fan comprising:

an elongated member having a shape corresponding to a leaf with a length greater than its width and with a perimeter having opposite sides;

the elongated member comprising one or more strips of material disposed in the elongated direction;

the elongated member having an obverse surface with an irregular topology and a reverse surface having a generally planar topology;

the reverse surface having means for laterally securing the elongated member to prevent separation and fragmentation of the blade.

2. The ceiling fan blade of claim 1 wherein the means for laterally securing the elongated member to prevent separation and fragmentation of the blade comprises one or more cross braces extending generally transverse to the grain of the wooden elongated member for supporting the elongated member.

3. The ceiling fan blade of claim 1 wherein the elongated member comprises wood.

4. The ceiling fan blade of claim 1 wherein the material is selected from the group consisting of balsa, butternut, jelutong, eastern white pine, sugar pine, aspen, poplar, alder, spruce, basswood, fir, hemlock, paulowina, chestnut, teak, cedar, plastic, particle board, and resin impregnated wood particles.

5. The ceiling fan of claim 1 wherein the reverse side of the elongated member has one or more channels that have a floor and sidewalls spaced apart by the floor.

6. The ceiling fan of claim 5 wherein the channels are filled with wooden brace members.

7. The ceiling fan of claim 6 wherein the wooden brace member has a grain running along the length of the brace member and transverse to the grain of the elongated member.

8. The ceiling fan of claim 1 wherein the elongated member comprises a plurality of strips of wood that are laterally fixed to adjacent strips to form a laminated body of wood.

* * * * *